US012055143B2

(12) United States Patent
Okhman et al.

(10) Patent No.: US 12,055,143 B2
(45) Date of Patent: Aug. 6, 2024

(54) SCREW COMPRESSOR WITH ADJUSTABLE PASSAGE

(71) Applicant: CARRIER CORPORATION, Palm Beach Gardens, FL (US)

(72) Inventors: David Okhman, Camillus, NY (US); David M. Rockwell, Cicero, NY (US); Amit Vaidya, Jamesville, NY (US); Yifan Qiu, Manlius, NY (US); Brandon Schwoeppe, Camillus, NY (US); Joshua S. Lavoie, North Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/767,243

(22) PCT Filed: Oct. 7, 2020

(86) PCT No.: PCT/US2020/054527

§ 371 (c)(1),
(2) Date: Apr. 7, 2022

(87) PCT Pub. No.: WO2021/071910

PCT Pub. Date: Apr. 15, 2021

(65) Prior Publication Data

US 2022/0372978 A1 Nov. 24, 2022

Related U.S. Application Data

(60) Provisional application No. 62/911,592, filed on Oct. 7, 2019.

(51) Int. Cl.
*F01C 1/16* (2006.01)
*F04C 18/00* (2006.01)
(Continued)

(52) U.S. Cl.
CPC ..... *F04C 18/16* (2013.01); *F04C 28/10* (2013.01); *F04C 29/12* (2013.01);
(Continued)

(58) Field of Classification Search
CPC ..... F04C 18/084; F04C 18/086; F04C 18/16; F04C 28/10; F04C 29/12; F04C 2230/60; F04C 2240/30; F04C 2240/805
See application file for complete search history.

(56) References Cited

U.S. PATENT DOCUMENTS 4,042,310 A 8/1977 Schibbye et al.
4,362,472 A 12/1982 Axelsson
(Continued)

FOREIGN PATENT DOCUMENTS

CN 202250878 5/2012
CN 102817844 12/2012
(Continued)

OTHER PUBLICATIONS

JP2012-172627A—Ochiai et al.—Screw compressor—Sep. 10, 2012—the English Machine Translation (Year: 2012).*
(Continued)

*Primary Examiner* — Theresa Trieu
(74) *Attorney, Agent, or Firm* — Carlson, Gaskey & Olds, P.C.

(57) ABSTRACT

A screw compressor includes an outlet housing. The outlet housing includes a passage that is configured to communicate compressed fluid from a screw rotor to a discharge. A removable cover plate is configured to cover a portion of the passage. A method of varying a volume index for a screw compressor is also disclosed.

18 Claims, 3 Drawing Sheets

(51) Int. Cl.

| | |
|---|---|
| ***F04C 18/16*** | (2006.01) |
| ***F04C 28/10*** | (2006.01) |
| ***F04C 29/12*** | (2006.01) |

(52) U.S. Cl.
CPC ..... *F04C 2230/60* (2013.01); *F04C 2240/30* (2013.01); *F04C 2240/805* (2013.01)

(56) References Cited

U.S. PATENT DOCUMENTS

| | | | | |
|---|---|---|---|---|
| 5,269,667 | A * | 12/1993 | Mauney | F04C 29/12 418/201.1 |
| 5,423,183 | A | 6/1995 | Folsom | |
| 6,733,251 | B2 | 5/2004 | Sakurabayashi et al. | |
| 9,435,340 | B2 | 9/2016 | Doepker et al. | |
| 9,651,044 | B2 | 5/2017 | Suitou et al. | |
| 9,664,418 | B2 | 5/2017 | Nemit, Jr. | |
| 9,970,440 | B2 | 5/2018 | Zhu | |
| 2015/0093273 | A1 | 4/2015 | Johnson et al. | |
| 2016/0003129 | A1 | 1/2016 | Swartzlander et al. | |
| 2016/0245555 | A1* | 8/2016 | Tanaka | F25B 17/02 |
| 2019/0186491 | A1 | 6/2019 | Perevozchikov et al. | |

FOREIGN PATENT DOCUMENTS

| | | | | |
|---|---|---|---|---|
| CN | 205977672 | U | 2/2017 | |
| CN | 104912800 | B | 3/2017 | |
| EP | 3273185 | | 1/2018 | |
| JP | S51106918 | | 9/1976 | |
| JP | 2000337283 | A * | 12/2000 | F04C 18/16 |
| JP | 3913106 | B2 | 5/2007 | |
| JP | 2012172627 | | 9/2012 | |
| JP | 5595209 | B2 | 9/2014 | |

OTHER PUBLICATIONS

CP Performance—Cover Plate—Alpha and Bravo Applications—Jan. 31, 2024—https://www.cpperformance.com/p-13860-cover-plate-alpha-and-bravo-applications.aspx (Year: 2024).*

CN202250878U—Diao et al.—Screw Compressor and Exhaust End Seat Orifice—May 30, 2012 - copy of the Abstract in English Machine (Year: 2012).*

The International Search Report for International Patent Application No. PCT/US2020/054527, mailed Nov. 30, 2020.

International Preliminary Report on Patentability for International Patent Application No. PCT/US2020/054527, mailed Feb. 17, 2022.

International Preliminary Report on Patentability for International Patent Application No. PCT/US2020/054527, mailed Apr. 21, 2022.

* cited by examiner

SCREW COMPRESSOR WITH ADJUSTABLE PASSAGE

CROSS-REFERENCE TO RELATED APPLICATIONS

This application claims the benefit of U.S. Provisional Application No. 62/911,592, filed Oct. 7, 2019, the disclosure of which is incorporated by reference herein in its entirety.

BACKGROUND

Screw compressors typically include a plurality of rotating rotors each having external screw thread. The screw threads interfit with screw threads on the other rotors to define compression chambers. An entrapped fluid is compressed, and delivered toward a downstream location. Compressed fluid is delivered into a discharge plenum.

Screw compressors can be operated at various pressure ratios (e.g., the ratio of the pressure of the fluid at the inlet of the compressor to the pressure of the fluid at the outlet of the compressor). Various parameters in the screw compressor can be optimized based on the desired pressure ratio.

SUMMARY

A screw compressor according to an exemplary embodiment of this disclosure, among other possible things includes an outlet housing. The outlet housing includes a passage that is configured to communicate compressed fluid from a screw rotor to a discharge. A removable cover plate is configured to cover a portion of the passage.

In a further example of the foregoing, the portion of the passage includes at least one sub-portion. The cover plate includes first and second legs joined by a bracket, and each of the first and second legs cover first and second sub-portions of at least one sub-portion.

In a further example of any of the foregoing, each of the first and second legs has a thickness. The thickness corresponds to a side of the first and second sub-portions, respectively.

In a further example of any of the foregoing, the first and second legs each have a first side adjacent the bracket and a second side opposite the first side. The cover plate includes an open edge between the second side of the first and second legs.

In a further example of any of the foregoing, the cover plate is attached to the outlet housing by one or more removable fasteners.

In a further example of any of the foregoing, the cover plate is a first cover plate that is configured to cover a first portion of the passage. The first cover plate is interchangeable with a second cover plate that is configured to cover a second portion of the passage.

In a further example of any of the foregoing, the first portion of the passage is a different size than the second portion of the passage.

In a further example of any of the foregoing, two screw rotors are configured to compress the fluid.

In a further example of any of the foregoing, the passage includes a rotor sweep surface, and the cover plate reduces an effective length of the rotor sweep surface.

A method of varying a volume index for a screw compressor according to an exemplary embodiment of this disclosure, among other possible things includes providing a removable cover plate for an outlet housing of a screw compressor. The outlet housing includes a passage that is configured to communicate compressed fluid from a screw rotor to a discharge. The cover plate is configured to cover a portion of the passage.

In a further example of the foregoing, the removable cover plate is selected from a group of removable cover plates.

In a further example of any of the foregoing, a desired volume index for the screw compressor is selected, and a removable cover plate from the group of removable cover plates is selected based on the desired volume index.

In a further example of any of the foregoing, the removable cover plate is configured to cover a portion of the passage. The size of the portion corresponds to the desired volume index.

In a further example of any of the foregoing, the removable cover plate is a first removable cover plate in the group of cover plates, and includes interchanging the removable cover plate with a second cover plate from the group of cover plates.

In a further example of any of the foregoing, the first removable cover plate is configured to cover a first portion of the passage, and the second cover plate is configured to cover a second portion of the passage, and the first portion has a different size than the second portion.

In a further example of any of the foregoing, the portion of the passage includes at least one sub-portion. The cover plate includes first and second legs joined by a bracket. Each of the first and second legs cover first and second sub-portions of at least one sub-portion.

In a further example of any of the foregoing, each of the first and second legs has a thickness. The thickness corresponds to a side of the first and second sub-portions, respectively.

In a further example of any of the foregoing, the first and second legs each have a first side adjacent the bracket and a second side opposite the first side. The cover plate includes an open edge between the second side of the first and second legs.

In a further example of any of the foregoing, the cover plate is attached to the outlet housing by one or more removable fasteners.

In a further example of any of the foregoing, the passage includes a rotor sweep surface, and the cover plate reduces an effective length of the rotor sweep surface

DETAILED DESCRIPTION

Figure 1:
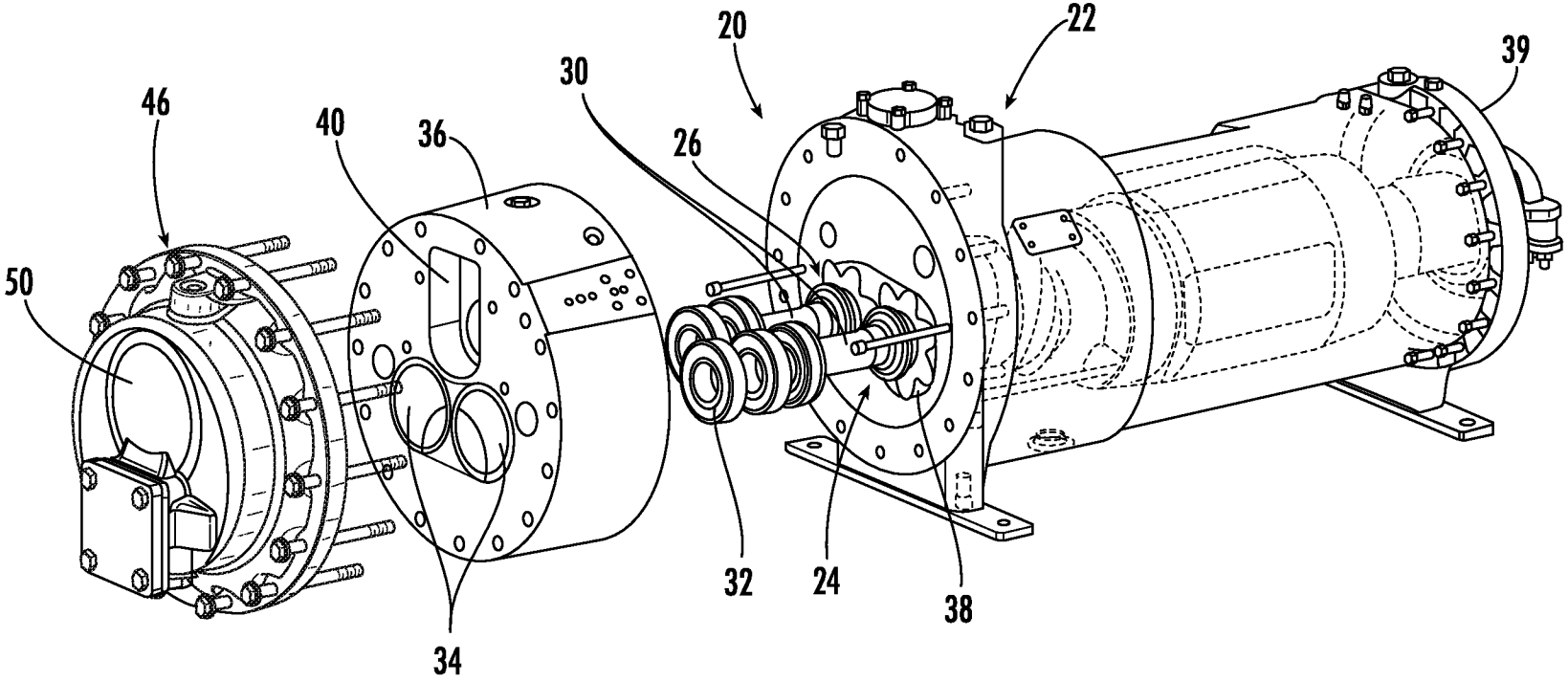
FIG. 1 schematically shows an example screw compressor.

An example screw compressor 20 is schematically illustrated in FIG. 1. A compressor case 22 carries screw rotors 24/26. Though FIG. 1 shows two screw rotors 24/26, more or less screw rotors could be used. The screw rotors 24/26 have threads or lobes which interfit to compress and drive a fluid toward a discharge 38. Fluid enters at an opposed end through an inlet 39. The rotors 24/26 each have shafts 30 which are mounted within bearing assemblies 32. The bearing assemblies 32 extend into chambers 34 in an outlet housing 36.

The outlet housing 36 includes a passage 40 which communicates with the discharge 38 and serves to deliver the compressed fluid downstream. A discharge case 46 includes a chamber 50 which communicates with the passage 40.

Figure 2A:
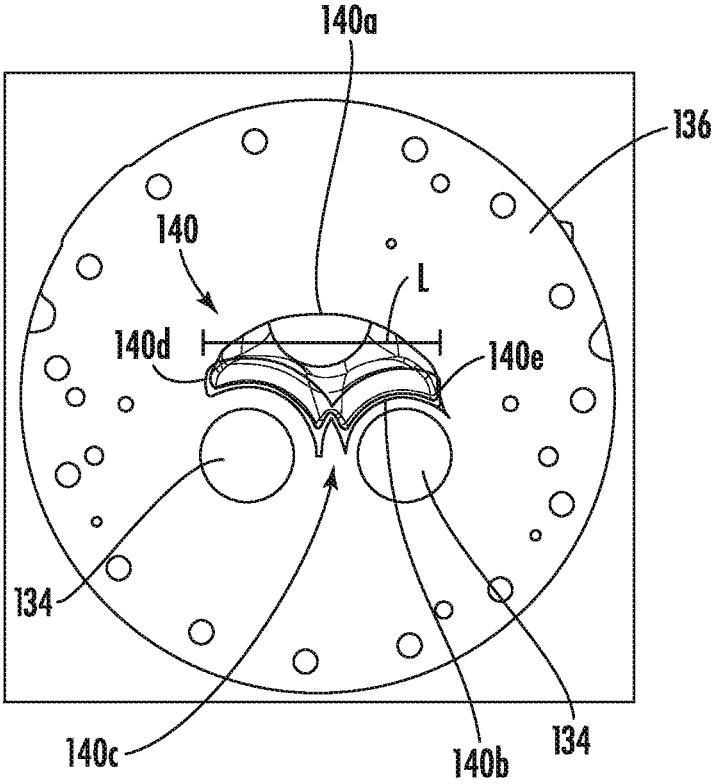
FIGS. 2A-B schematically show an example outlet housing for a screw compressor.
Figure 2B:
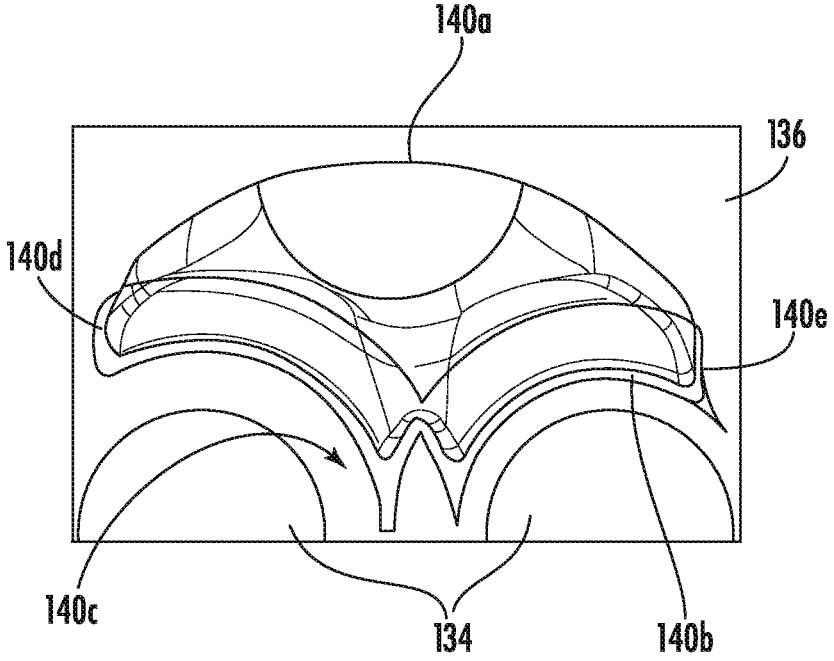

Turning now to FIGS. 2A-B, an example outlet housing 136 is shown. In this example, the outlet housing 136 includes two chambers 134 which each receive a bearing 32 that corresponds to a screw rotor 24/26 (FIG. 1). Though this example shows two chambers 134 that correspond to two screw rotors 24/26, more or less chambers 134/screw rotors could be used depending on the number of screw rotors.

A passage 140 is configured to communicate with discharge 38 and deliver compressed fluid to a downstream discharge as discussed above. In this example, the passage 140 has a radially outer edge 140*a* with an arcuate shape. The radially outer edge 140*a* joins a radially inner edge, which defines a rotor sweep surface 140*b*. The rotor sweep surface 140*b* is bound by two sides 140*d*, 140*e*. In one example, the sides 140*d*, 140*e* are non-straight. In a particular example, the left side 140*d* is convex with respect to a center of the passage 140 and the right side 140*e* is concave with respect to a center of the passage 140. The rotor sweep surface 140*b* has a length L defined between the sides 140*d*, 140*e*. The rotor sweep surface 140*b* maintains the fluid flow in a compressed state as it exits the discharge chambers 38. The side walls 140*d* and 140*e* have a curved profile that generally tracks the shape of the screw rotor 24/26 lobes at the discharge 38. The side wall 140*d* is convex and 140*e* is concave because one of the rotors 24/26 is male and the other of the rotors 24/26 is female, so when the lobes of these rotors 24/26 open to the discharge 38, the walls of the lobes of the rotors 24/26 at the discharge 38 track their respective curvatures. In this example, the rotor 24 is male, and the rotor 26 is female. In this example, a central portion 140*c* of the rotor sweep surface 140*b* protrudes down into a space between the chambers 134, with a "W" shape, which is also referred to as a "butterfly" shape, at the radially innermost edge. However, other profiles are contemplated.

The length L of the rotor sweep surface 140*b*, and ultimately the cross-sectional area of the passage 140, is related to a volume index of the screw compressor 20. The volume index is a ratio of the volume of fluid confined between the screw rotors 24/26 at the beginning of the compression process, e.g., near the inlet 39, to the volume of fluid confined between the screw rotors 24/26 where the screw rotors 24/26 open to the discharge 38 Changing the length L and thus the cross-sectional area of the passage 140 changes the volume index of the screw compressor 20 by changing the volume of fluid trapped between the screw rotors 24/26 as the screw rotors 24/26 open to the discharge 38.

The pressure ratio of the screw compressor 20 is the ratio of the pressure of the fluid at the inlet 39 to the pressure of the fluid at the discharge chambers 38. For a given pressure ratio, there is a volume index that maximizes efficiency of the screw compressor 20.

Figure 3A:
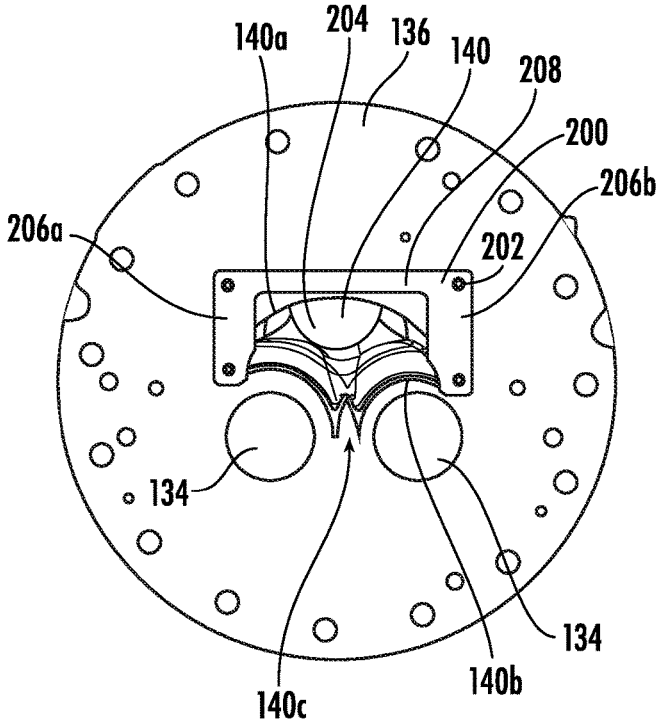
FIGS. 3A-C schematically show an example cover plate for the outlet housing of FIG. 2.
Figure 3B:
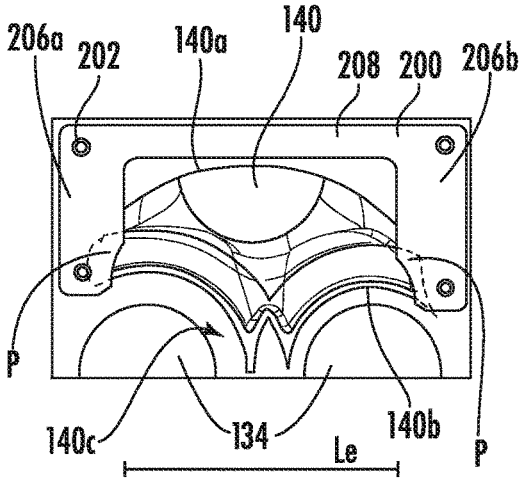
Figure 3C:
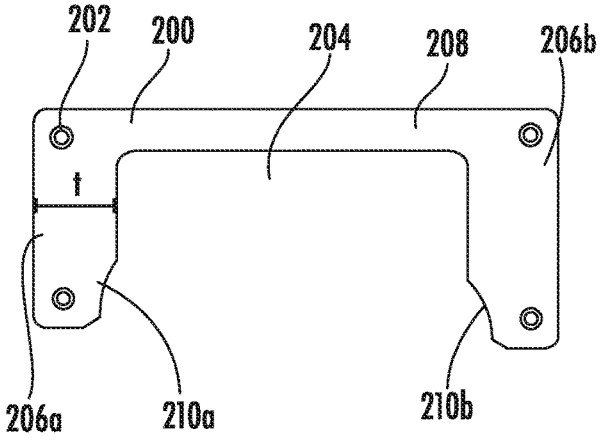

FIGS. 3A-B show the outlet housing 136 with a removable or interchangeable cover plate 200. FIG. 3C shows the cover plate 200 in isolation. The cover plate 200 is attached to the outlet housing 136 via removable fasteners 202, such as screws, or another type of fastener. In the example shown, there are four fasteners 202, but more or less fasteners could be used.

The cover plate 200 has an open area 204 which corresponds to effective cross-sectional area of the passage 140 when the cover plate 200 is installed. The cover plate 200 covers a portion of the passage 140 so that the effective cross-sectional area of the passage 140 is reduced, and thus the volume index for the screw compressor 20 is increased. In the example of FIGS. 3A-C, the cover plate includes two legs 206*a*, 206*b* on either side of the opening 204. The legs 206*a*, 206*b* are joined by a bracket 208 at a first end of each leg 206*a*, 208*a*. Each of the legs 206*a*, 206*b* cover a sub-portion P of the passage 140 on either side of the passage 140 (shown in FIG. 3B). The top (radially outer) edge of the opening 204 is rectangular in shape, though other shapes are contemplated.

The cover plate 200 has an open edge between a second end of the legs 206*a*, 206*b* opposite the end of the legs 206*a*, 206*b* joined by the bracket 208. Additionally, the second end of each leg 206*a*, 206*b* includes a divot 210*a*, 210*b* respectively. The shape of the divots correspond to the shape of the sides 140*d*, 140*e* of the passage 140 (shown in FIGS. 2A-B). Therefore, the shape or profile of the rotor sweep surface 140*b* is maintained, and only the effective length Le of the rotor sweep surface is changed by the cover plate 200.

Each of the legs 206*a*, 206*b* has a thickness t (FIG. 3C) that corresponds to a size of the sub-portion P (shown in phantom in FIG. 3B) on either side of the passage 140 covered by the respective leg 206*a*, 206*b*. The larger the thickness t of the legs 206*a*, 206*b*, the larger the cumulative portion (e.g., the sum of sub-portions P) of the passage 140 that is covered, the smaller the effective length Le of the rotor sweep surface 140*b*, and the smaller the effective cross-sectional area of the passage 140. Therefore, the larger the thickness t, the greater the volume index of the screw compressor 20.

The example cover plates 200 are part of a group of cover plates 200. The cover plates 200 in the group can have varying thicknesses t for the respective legs 206*a*, 206*b*. All of the cover plates 200 in the group are removable, meaning they can be removed and/or interchanged with others of the cover plates 200 in the group to vary the effective length Le of the rotor sweep surface and the cross-sectional area of the passage 140. In this way, the volume index for the screw compressor 20 can be varied. As was discussed above, the cover plate 200, and thus volume index, can be selected to maximize efficiency for a given pressure ratio for the screw compressor 20.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A screw compressor, comprising:

an outlet housing, the outlet housing including a passage having a rotor sweep surface and configured to communicate compressed fluid from a screw rotor to a discharge; and a removable cover plate configured to cover a portion of the passage, wherein the removable cover plate includes at least one divot, and wherein the removable cover plate reduces an effective length of the rotor sweep surface and the at least one divot maintains a profile of the rotor sweep surface.

2. The screw compressor of claim 1, wherein the portion of the passage includes at least one sub-portion, and wherein the removable cover plate includes first and second legs joined by a bracket, and wherein each of the first and second legs cover first and second sub-portions of at least one sub-portion.

3. The screw compressor of claim 2, wherein each of the first and second legs has a thickness, and wherein the thickness corresponds to a side of the first and second sub-portions, respectively.

4. The screw compressor of claim 2, wherein the first and second legs each have a first side adjacent the bracket and a second side opposite the first side, and wherein the removable cover plate includes an open edge between the second side of the first and second legs.

5. The screw compressor of claim 2, wherein the first and second legs are joined by the bracket at a first end of the first leg and a first end of the second leg, and wherein each of the first and second legs include a second end, and the at least one divot comprises a first divot at the second end of the first leg and a second divot at the second end of the second leg.

6. The screw compressor of claim 1, wherein the removable cover plate is attached to the outlet housing by one or more removable fasteners.

7. The screw compressor of claim 1, wherein the removable cover plate is a first cover plate configured to reduce the effective length of the rotor sweep surface, and wherein the first cover plate is interchangeable with a second cover plate configured to reduce the effective length of the rotor sweep surface .

8. The screw compressor of claim 1, further comprising two screw rotors configured to compress the fluid.

9. A method of varying a volume index for a screw compressor, comprising:

providing a removable cover plate for an outlet housing of a screw compressor, the outlet housing including a passage having a rotor sweep surface and configured to communicate compressed fluid from a screw rotor to a discharge, the removable cover plate configured to cover a portion of the passage, wherein the removable cover plate includes at least one divot, and wherein the removable cover plate reduces an effective length of the rotor sweep surface and the at least one divot maintains a profile of the rotor sweep surface.

10. The method of claim 9, further comprising selecting the removable cover plate from a group of removable cover plates.

11. The method of claim 10, further comprising selecting a desired volume index for the screw compressor, and selecting the removable cover plate from the group of removable cover plates based on the desired volume index.

12. The method of claim 11, wherein the removable cover plate is configured to cover the portion of the passage, and the size of the portion corresponds to the desired volume index.

13. The method of claim 10, wherein the removable cover plate is a first removable cover plate in the group of cover plates, and further comprising interchanging the removable cover plate with a second cover plate from the group of cover plates.

14. The method of claim 13, wherein the first removable cover plate is configured to reduce the effective length of the rotor sweep surface, and the second cover plate is configured to reduce the effective length of the rotor sweep surface.

15. The method of claim 9, wherein the portion of the passage includes at least one sub-portion, and wherein the removable cover plate includes first and second legs joined by a bracket, and wherein each of the first and second legs cover first and second sub-portions of at least one sub-portion.

16. The method of claim 15, wherein each of the first and second legs has a thickness, and wherein the thickness corresponds to a side of the first and second sub-portions, respectively.

17. The method of claim 15, wherein the first and second legs each have a first side adjacent the bracket and a second side opposite the first side, and wherein the removable cover plate includes an open edge between the second side of the first and second legs.

18. The method of claim 9, further comprising attaching the removable cover plate to the outlet housing by one or more removable fasteners.

* * * * *